US005218729A

United States Patent [19]

Walton

[11] Patent Number: 5,218,729

[45] Date of Patent: Jun. 15, 1993

[54] BED SHEET CLAMPING HOLDER

[76] Inventor: Donald L. Walton, 8502 Woodside Ct., Lanham, Md. 20706

[21] Appl. No.: 894,290

[22] Filed: Jun. 4, 1992

[51] Int. Cl.[5] ..... A47C 21/02

[52] U.S. Cl. ..... 5/504.1; 5/658

[58] Field of Search ..... 5/658, 496, 498, 504.1; 24/72.5

[56] References Cited

U.S. PATENT DOCUMENTS

| | | | |
|---|---|---|---|
| 3,092,848 | 6/1963 | Gronvold | 5/498 |
| 3,767,092 | 10/1973 | Garrison et al. | 223/96 |
| 4,199,831 | 4/1980 | Müller | 5/498 |
| 4,539,723 | 9/1985 | Hillsberry | 5/504.1 |
| 4,541,137 | 9/1985 | Murray | 5/658 |
| 4,698,880 | 10/1987 | Hamm | 5/498 |
| 4,712,262 | 12/1987 | Viggiano | 24/72.5 |
| 4,826,056 | 5/1989 | Duester et al. | 223/96 |
| 4,829,617 | 5/1989 | Dameron | 5/658 |
| 5,131,104 | 7/1992 | Larson | 24/72.5 |

*Primary Examiner*—Peter M. Cuomo
*Assistant Examiner*—Michael J. Milano

[57] ABSTRACT

A device for holding a fitted sheet to a mattress. The holder is provided with a base portion upon which a corner of a mattress is to be positioned, a rail attached to the base for positioning the device respective to the mattress and clamps connected to the rail and base to grip the edges of the sheet.

2 Claims, 1 Drawing Sheet

BED SHEET CLAMPING HOLDER

BACKGROUND OF THE INVENTION

The present invention relates to a holder for clamping a bed sheet to a mattress. More particularly to a holder used to clamp a fitted sheet over the corners of a mattress.

It is conventional to use a fitted sheet as the bottom sheet on a mattress and a top flat sheet which is folded around the corners at the foot of a mattress as a top sheet. The fitted bottom sheet is generally constructed to have four corner pockets which will fit snugly about the mattress corners and thereby hold the bottom sheet taut and securely to the mattress. One difficulty with a fitted sheet is when a mattress has a thickness greater than was intended for the fitted sheet the corners of fitted sheet will slide up and off the mattress. Another problem with a fitted sheet is when washed it tends to shrink until it no longer will stay in place even on a mattress with the desired dimensions. Other reasons for a fitted sheet to not have sufficient pocket sizes to fit the mattress on a bed could be due to the use of thick mattress pads such as sheepskin or so-called egg box mattress pads.

Devices for attaching and holding sheets over a mattress are known. It is known to attach a bed sheet to a spring mattress using elastic straps positioned under and across the corners of a mattress and attached to the sheet with garter clips or spring clamps.

U.S. Pat. No. 1,195,874 discloses elastic straps with spring clamps used to hold bedclothes to a mattress.

U.S. Pat. No. 4,862,541 discloses a device constructed with a inextensible strap provided with fasteners at each end. The strap is to be positioned under the mattress across the corner and the fasteners attached to the corners of the sheet. The fasteners disclosed by '541 are similar to the garter clip type in their operation. The stud which is separate from the necked plate member is used to push the sheet material through the slotted plate opening and slid along the slot to clamp the sheet.

The sheet holders of the prior art are difficult to use. The straps whether elastic or inextensible used across and under the corner of a mattress tends to move about when the bed is being made. When the sheet, whether it be a fitted type or a flat sheet, is positioned on the mattress then one must find and position the strap so the fasteners may be attached to the sheet. It is quite common as one end of the holding strap is attached to the sheet the other end is pulled out of position. Since a mattress is bulky and somewhat heavy it can be quite tiring to connect such straps.

Another problem with the known straps used to hold sheets in position on a mattress is the attaching means. Garter clips as pointed out by 4,862,541 are useful for only a single sheet thickness and cannot be used to hold both top and bottom sheets. Such clips further tend to turn loose and are difficult to attach to the sheet when the sheet is taut. Some of the garter clip problems are overcome by '541's heavier fasteners. The straps are still difficult to manage and the knobs may be misplaced.

SUMMARY OF THE INVENTION

The present invention provides a bed sheet holder which is particularly suited for holding either fitted or flat sheets over a mattress. The sheet holder is easily positioned under the mattress corners and will stay in position as the bed is being made. The sheet attachment means is held in its desired position and is ready to be clamped to the edges of the sheet.

The holder of the present invention includes an integrally molded clamping means for holding the sheet corner. The gripping portion of the holder is provided with a locking clip. Such clamps are known as disclose by U.S. Pat. Nos. 3,767,092 and 5,082,153.

Accordingly, it is the primary object of this invention to provide a bed sheet clamping holder which is easy to use and make.

Another object of the present invention is to provide a base member with a rail having complementary shape of a mattress corner and clamping means located at each end of the rail.

Another object of the present invention is to provide a sheet holder for holding a sheet in position on a mattress with a clamp having gripping members integrally hinged at one end and including a locking clip which is slidably mounted over the hinged edge of the clamp.

DESCRIPTION OF THE PREFERRED EMBODIMENT

Figure 1:
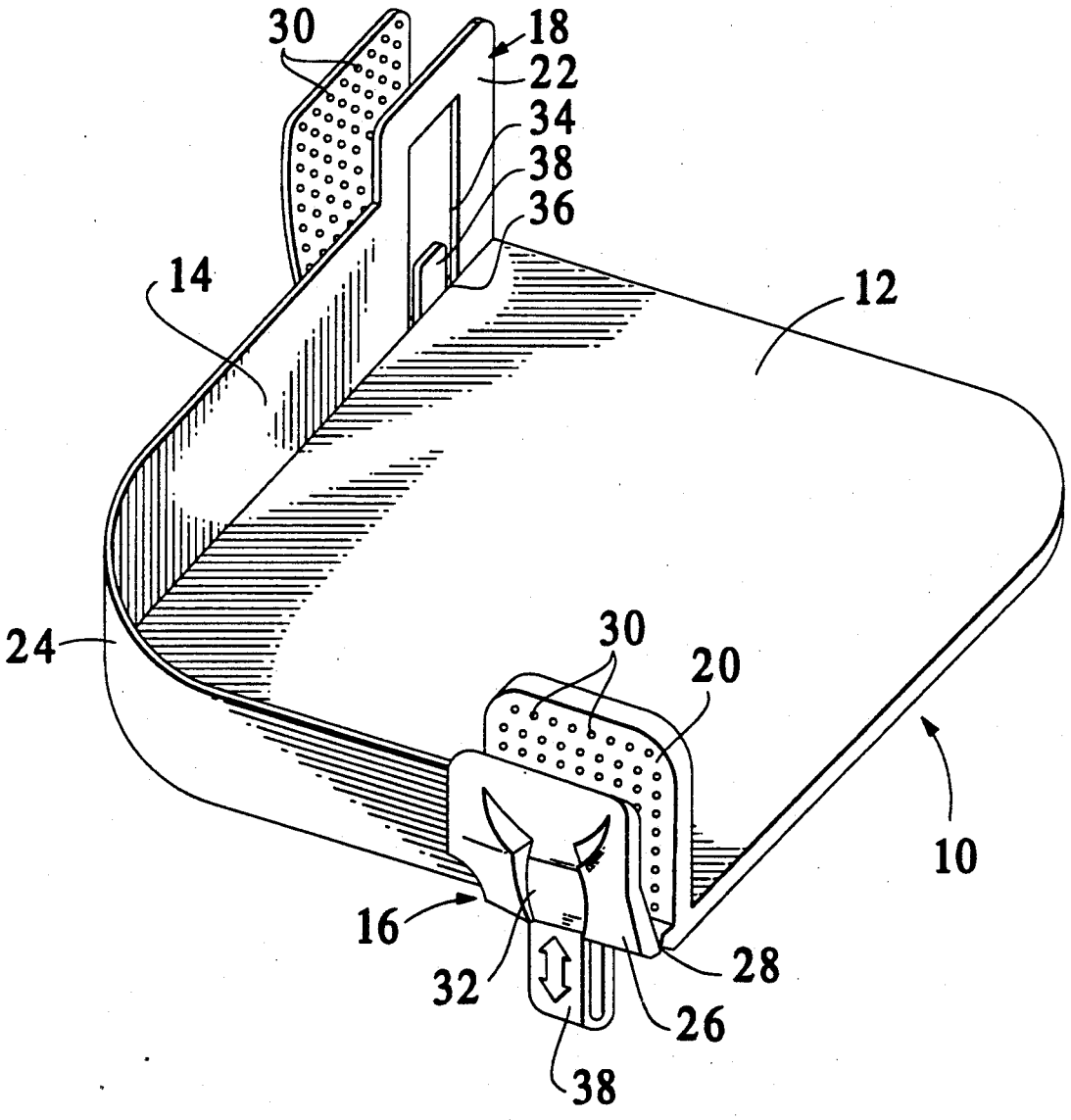
FIG. 1 is a perspective of the preferred embodiment of the invention.

The sheet holder 10 as illustrated in FIG. 1 is preferably constructed of integrally molded plastic material. The holder 10 comprises a flat base portion 12 attached to a rail member 14 and holding clamps 16 and 18. Rail member 14 is attached at each end to the rear gripping members 20 and 22 of clamps 16 and 18 with the rail member and clamps extending at right angle to the base portion 12 forming a tray-like holder. The rail member and base are provided with a rounded corner 24 which is complimentary in shape to the corner of a mattress on which the sheet holder is intended to be used. When a mattress is positioned on top of the base portion 12 and butted against rail member 14 the sheet holder will remain in position, with the clamps 16 and 18 located along the sides of the mattress corner, while a fitted sheet is being stretched onto the mattress. The corner of the fitted sheet will be stretched over the mattress corner and over the sheet holder 10 at the rounded corner 24. As the fitted sheet is stretched over the sheet holder the edges of the sheet will easily slide into the open jaws of the clamps 16 and 18 which can then be closed to clamp the sheet into its desired position over the mattress corner. Clamps 16 and 18 are identical, therefore, a description of claim 16 is sufficient to describe both clamps.

The preferred clamps comprise a pair of gripping members 20 and 26 with the rear gripping member 20 being integrally formed with the base portion and rail member 14. The front gripping member 26 is integrally molded with the rear gripping member being joined by relatively thin member 28 forming a plastic hinge which allows relative movement of the gripping members between an open and closed position. The inner surface of the gripping members are provided with projections 30 to enhance the gripping member force of the clamps. A recess 32 on the front gripping member and a recess 34 and slot 36 (shown on clamp 18) on the rear gripping member are provided to accommodate a slidable spring locking clip 38. The locking clip 38 when in its locked position closes the jaws of the gripping members and provides a spring biased force on the gripping members.

For a more detailed description of the clamps illustrated in FIG. 1 reference is made to U.S. Pat. No. 3,767,092.

Other materials could equally well be used in constructing the holder 10. The base 12 could be made of wood. The rail 14 and clamps 16 and 18 integrally molded of plastic material being attached to the base 12 by any suitable means. Other known clamp designs such as disclosed in U.S. Pat. No. 5,082,153 could equally well be used in place of the clamps illustrated in FIG. 1.

It will be apparent to one having ordinary skill in the art that various modifications to the preferred embodiment described can be made without departing from the spirit or scope of the present invention, as defined by the appended claims. For example, the base portion may have a triangular shape.

What is claimed is:

1. A device for holding a sheet on the corner of a mattress: comprising a flat base portion, a rail member attached to said base portion, and a pair of clamps for gripping the sheet, said rail member and said clamp being integrally molded plastic rigidly connected to said base portion and extending perpendicular from said base portion to form a tray-like holder with said base portion, said rail member having a rounded corner into which the rounded corner of a mattress may be positioned; said pair of clamps comprise a rear gripping member connected to said base portion and to the ends of said rail member, a front gripping member, and a plastic hinge connecting said rear member and said front member together at one edge, said clamps being attached to said flat base with said plastic hinge located in substantially the same plane as said base, a spring clip positioned over said hinge and held slidably by said rear gripping member, said spring clip being movable between a closed position and an open position for biasing said front gripping member together with the rigid rear gripping member when in the closed position.

2. The device according to claim 1 wherein said base portion, said rail member and said pair of clamps are integrally molded plastic.

* * * * *